US007159705B2

(12) United States Patent
Ogimura et al.

(10) Patent No.: US 7,159,705 B2
(45) Date of Patent: Jan. 9, 2007

(54) PASSENGER CONVEYOR DEVICE

(75) Inventors: Yoshio Ogimura, Saitama-ken (JP); Takayuki Kikuchi, Saitama-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/415,889

(22) PCT Filed: Nov. 9, 2001

(86) PCT No.: PCT/JP01/09843

§ 371 (c)(1),
(2), (4) Date: Oct. 27, 2003

(87) PCT Pub. No.: WO02/38483

PCT Pub. Date: May 16, 2002

(65) Prior Publication Data

US 2004/0099503 A1 May 27, 2004

(30) Foreign Application Priority Data

Nov. 9, 2000 (JP) ..... 2000-341953

(51) Int. Cl.
*B66B 21/00* (2006.01)

(52) U.S. Cl. ..... 198/326; 198/333; 198/327; 198/328

(58) Field of Classification Search ..... 198/326, 198/333, 327, 328
See application file for complete search history.

(56) References Cited

U.S. PATENT DOCUMENTS 2,163,693 A 6/1939 Margles
4,064,986 A * 12/1977 Bertovich ..... 198/326
4,569,433 A * 2/1986 Ishida et al. ..... 198/333
5,024,314 A * 6/1991 Kitamura et al. ..... 198/333
5,062,519 A * 11/1991 Haruta ..... 198/333
5,435,428 A * 7/1995 Adachi et al. ..... 198/324
5,472,075 A * 12/1995 Yamashita et al. ..... 198/324
5,829,570 A * 11/1998 Kwon ..... 198/326
5,899,314 A * 5/1999 Kwon ..... 198/332
5,924,544 A * 7/1999 Kwon ..... 198/326

(Continued)

FOREIGN PATENT DOCUMENTS

JP 2-282185 11/1990

(Continued)

*Primary Examiner*—Gene O. Crawford
*Assistant Examiner*—Rashmi Sharma
(74) *Attorney, Agent, or Firm*—Oblon, Spivak, McClelland, Maier & Neustadt, P.C.

(57) ABSTRACT

A plurality of steps 33 are connected to a pair of step chains 32 wound around step chain sprockets 30. The step chain sprockets 30 drives the step chains 32 to turn the step chains 32 through a forward path 43*a*, a return path 43*b*, and reversing areas at the opposite ends of the forward path and the return path. Front wheels 39 are supported on shafts attached to the opposite side surfaces of a front part of the step 33 and connected to the step chains 32, respectively. Rear wheels 40 are supported on a rear part of the step 33. Front wheel guide rails 44 supporting and guiding the front wheels 39 and rear wheel guide rails 45 for supporting and guiding the rear wheels 40 guides the step 33 in the forward path. In the reversing area, in which the step is inverted, an auxiliary step guide means including auxiliary rollers 41 and auxiliary roller guide rails 46 controls the position of the step 33 such that the rear wheels approach a connecting shaft 30*a* supporting the step chain sprockets 30. The depthwise dimension of a part, corresponding to the reversing unit, of a frame is small.

21 Claims, 15 Drawing Sheets

U.S. PATENT DOCUMENTS 6,390,270 B1 * 5/2002 Utsunomiya et al. ..... 198/326

FOREIGN PATENT DOCUMENTS

JP 3-211186 9/1991
JP 6-171877 6/1994
JP 2000-177965 6/2000

* cited by examiner

PASSENGER CONVEYOR DEVICE

TECHNICAL FIELD

The present invention relates to a passenger conveyer system having a plurality of steps (including pallets of moving sidewalk) for conveying passengers between two points and, more particularly, to a passenger conveyer system including frame accommodated in a space under the floor of a building and having a small depthwise dimension along depth from the surface of the floor.

BACKGROUND OF THE INVENTION

Installation of escalators and moving sidewalks has been accelerated in recent years to cope with the progressively advancing aging society. Particularly, facilities of public transportation, such as railroads, are supposed to be used by the general public and buildings of such facilities have structural functions to enable vehicles and persons to move intersecting traffic lines, respectively. Persons need inevitably to ascend and descend in such buildings. Thus, the use of escalators for mass transportation is a natural consequent.

FIG. 13 is a side elevation of a conventional escalator by way of example, installed in a station building on the aforementioned demand. Shown in FIG. 13 are an escalator 1, an upper frame 2*a*, a lower frame 2*b* and a middle frame 2*c*, which are assembled to build a frame 2. Support members 3*a* and 3*b* at the opposite ends of the frame 2 suspend the frame 2 from a building 4. Indicated at A, B and C are the depthwise dimensions of the upper frame 2*a*, the lower frame 2*b* and the middle frame 2*c*, respectively.

Generally, an escalator is installed beside a staircase in most station buildings. An existing station building has a staircase 5 along a passenger flow. Therefore, any space is unavailable in a place other than the staircase 5 or a space available for installing an escalator does not coincide with the passenger flow. When an escalator needs to be installed in such an existing station building, it is usual to demolish or modify part of the staircase 5 and a part of the associated platform or concourse and to install the escalator alongside the staircase 5.

A roof 6 is placed above the existing staircase 5 in most cases. Since the escalator has the frame 2 having the foregoing depthwise dimensions, it is usual to form openings capable of passing the frame 2 in the existing staircase 5 and a platform 7 and to insert the frame 2 through the openings in pits to secure a clearance K under the roof 6. In FIG. 13, the openings are formed in hatched parts.

As shown in FIGS. 14 and 15, the depthwise dimensions A, B and C of the frame 2 are dependent principally on the dimensions of spaces for accommodating a step turning mechanism and a forward-and-return mechanism.

FIG. 14 is a sectional view of the upper frame 2*a*. Shown in FIG. 14 are steps 10 each having a rear riser 10*a*, step chains 11 connected to the opposite side parts of the steps 10 to haul up the steps 10, front wheels 12 supporting the steps 10, rear wheels 13 supporting the steps 10, step chain sprockets 15 disposed on the opposite sides of the steps 10, a connecting shaft 14*a* connecting the right and the left step chain sprocket 14, a front wheel guide rail 15 for guiding the front wheels 12, and a rear wheel guide rail 16 for guiding the rear wheels 13. The step chains 11 are wound around the step chain sprockets 14.

The steps 10 move around the step chain sprockets 14 in opposite directions. Since the rear wheels 13 of each step 10 are spaced downward from a rear part of the step 10, the size D of a gap decreases as the steps 10 approach each other while the steps 10 move around the step chain sprockets 14. Therefore, step 10 is unable to move along a circular path of a smaller radius. Thus, the radius of the circular path is a dominant factor of determining a depthwise dimension necessary for turning the step 10. Since the rear wheels 13 of the step 10 are below the riser 10*a* of the step 10, the height of the step 10 must be not smaller than the sum of the height of the riser 10*a* and the diameter of the rear wheels 13. In addition, since each rear wheel 13 is supported and guided by the rear wheel guide rail 16 and moves around the sprocket shaft 14*a*, a space of a thickness not smaller than the sum of the thickness of the rear wheel guide rail 16 and the diameter of the sprocket shaft 14*a* must be formed between a forward path and a return path. Thus, the depthwise dimension A of the upper frame 2*a* is dependent on those structural parameters.

Similarly, as shown in FIG. 15 in a sectional view, the depthwise dimension C of the middle frame 2*c* is dependent on the size of the riser 10*a* of the step 10, the diameter of the rear wheel 13, and the size of cross beams 17 connecting the right and the left portions of the middle frame 2*c*.

Although the lower frame 2*b* is not shown particularly, the depthwise dimension B of the lower frame 2*b* is dependent on structural parameters similar to those dominating the depthwise dimension of the upper frame 2*a*.

In relation with the aforementioned problem, Japanese patent laid-open publications Nos. JP Hei11-222370A and Nos. JP 2000-177964A disclose the measures to reduce the depthwise dimension of the frame.

FIG. 16 is a side elevation of an escalator disclosed in JP Hei11-222370A having a frame of a reduced depthwise dimension. A step 20 has a tread 20*a* and a riser 20*b* joined by a hinge 21 to the tread 20*a*. The riser 20*b* is suspended from the tread 20*a* while the step 20 is moving along a forward path, and is turned into a space under the tread 20*a* while the step 20 is moving along a return path. Thus, the height of the step 20 is reduced while the step 20 moves along the return path, which reduces a dimension C of a middle frame 2*c*.

The upper surface of the tread 20*a* of the step 20 always faces up. In the reversing area 22, the step 20 reverses the moving direction thereof without inverting the step 20 upside down.

FIG. 17 is a plan view of the step reversing area 22 of the escalator shown in FIG. 16 taken from above the reversing area 22. The steps 20 is connected to one another via right and left step chains 11. Step chain sprockets 14*c* and 14*d* disposed in the reversing area 22 drives the step chains 11. The step chain sprockets 14*c* and 14*d* are not connected by a connecting shaft; the same are supported on individual shafts 14*e* and 14*f*, respectively. The shafts 14*e* and 14*f* are interlocked with an intermediate shaft 24 by transmission mechanisms 23*a* and 23*b*, respectively. The intermediate shaft 24 is driven through a transmission mechanism 25 by a drive motor 26.

Since the steps 20 are not inverted upside down in the reversing area 22, there is not any trouble due to interference, which may occur when the step is inverted, between parts relating with the size D shown in FIG. 14. Since the step chain sprockets 14*c* and 14*d* are not connected by a shaft, the steps are able to move through a space between the step chain sprockets 14*c* and 14*d*. Thus, an upper frame 2*a* can be formed in small dimensions.

Incidentally, the step chain sprockets 14*c* and 14*d* must be driven synchronously in driving the step 20 because the step chain sprockets 14*c* and 14*d* are supported separately. In this example, the intermediate shaft 24 is used for the synchronous driving of the step chain sprockets 14*c* and 14*d*. The rotation of the output shaft of the drive motor 26 is transmitted to the intermediate shaft 24 by the transmission mechanism 25, and the driving force of the intermediate shaft 24 is transmitted to the step chain sprockets 14*c* and 14*d*.

FIG. 18 is a plan view of a step reversing unit disclosed in JP 2000-177964A. Step chain sprockets 14*c* and 14*d* are disposed separately on the right and the left side of step reversing area, and a step 20 moves through a space in which any shaft is not extended. The step chain sprockets 14*c* and 14*d* are driven synchronously by distributing the rotative force of a drive motor 26 by a transmission mechanism 25, an intermediate shaft 24 and gear mechanisms 27 to the step chain sprockets 14*c* and 14*d*.

These measures, however, has the following problems.

First, the step 20 has the riser 20*b* joined to the tread 20*a* by the hinge and the riser 20*b* turns relative to the tread 20*a* once every movement of the step 20 through a circulation loop. Since the escalator operates continuously in most cases, the turning of the riser 20*b* relative to the tread 20*a* is repeated. Consequently, related parts are worn severely by the repetitive turning of the riser 20*b*, increasing time and expenses for maintenance. The turning motion of the riser 20*b* generates noise, and increase in the number of parts raises the cost.

Secondly, it is virtually impossible to keep perfectly the step chain sprockets 14*c* and 14*d* individually supported on the shafts, respectively, and driven through the intermediate shaft 24 in phase with each other due to mechanical plays in the transmission system for transmitting power from the intermediate shaft 24 to the step chain sprockets, and subtle phase differences between transmission gears mounted on the intermediate shaft 24 and the shafts 14*e* and 14*f*, and hence some difference between the phases of the step chain sprockets needs to be permitted.

The tread 20*a* of the step 20 of the escalator is provided with a plurality of longitudinal grooves, and comb plates, arranged at its opposite landings, each having teeth that engage in the longitudinal grooves. The lateral clearance between the side wall of the longitudinal groove and each tooth engaged in the longitudinal groove is on the order of 1 mm. Supposing that the step 20 has a longitudinal dimension of 400 mm, the lateral displacement of the step 20 is on the order of 1/400=0.0025. If the distance between the right and the left step chain sprockets is 1400 mm, the allowable phase difference between the left and right step chain sprockets is 0.0025×1400=3.5 mm. According to the recent escalator using mode, it is general that stationary people stand on one side of the steps 20 and walking people walk on the other side of the steps 20. Load that may be placed on the machine by a walking person is more than twice the load that may be place on the machine by a stationary person. Load on the steps affects the elongation with time of the right and the left step chain directly. Although it is possible to keep the lateral phase difference always at 3.5 mm or below, taking changes with time, structures having high rigidities are inevitably large. Thus, many problems, such as the necessity of frequent maintenance, arise in addition to problems relating with the cost.

As mentioned above, part of an existing, operating station building needs a considerable modification and part of the station building needs to be temporarily demolished to carry necessary materials into the station building to install a new escalator in the existing, operating station building, which requires huge expenses and a long time for installation. Particularly, when an escalator is installed alongside a staircase, large openings must be formed in the staircase and the floor of the platform to put the frame partly in a pit under the staircase and the platform, which requires very large expenses. If strength members underlie the staircase, the staircase must be removed and other strength members must be installed, which further increases expenses.

The enlargement of the scale of the work for modifying the building extends the time for installation. The work for modifying the operating station building requires enhanced safety measures including fences for surrounding a work area and curing, extends the period during which inconvenience is imposed on persons using the station building, and cause various large losses.

Those problems arise because the frame of the escalator has a big depthwise dimension and hence the reduction of the depthwise dimension is a significant problem in the conventional escalator.

SUMMARY OF THE INVENTION

Accordingly, it is an object of the present invention to provide a passenger conveyer system including improved steps, an improved guide structure for reversing the moving direction of the steps, and a frame having a small depthwise dimension. Another object of the present invention is to provide a passenger conveyer system capable of solving problems in the reliability, the facility of maintenance and the cost of moving steps of the conventional escalator and problems in ensuring the synchronous driving of the separately supported right and left step chain sprockets of the conventional escalator, of facilitating manufacture and maintenance, and including a frame having a small depthwise dimension.

To achieve the objectives, the present invention provides a passenger conveyer system, which includes: a plurality of steps each provided with front wheels and rear wheels; a pair of endless step chains for carrying the steps in a successive arrangement; a pair of step chain sprockets, around which the step chains are wound, that reverses a moving direction of the steps to move the steps for circulation movement via the step chains; a connecting shaft connecting the pair of step chain sprockets to each other; a drive unit that drives the pair of step chain sprockets; guide rails that support and guide the steps in a forward path and a return path of a circulation loop of the steps; and auxiliary step guide means configured to control the attitude of the step in a reversing area of the circulation loop of the steps without supporting and guiding the rear wheels of the step.

The auxiliary step guide means may include auxiliary rollers respectively supported on opposite sides of each of the step, and auxiliary guide rails that engage with and guide the auxiliary rollers.

The front wheels and the rear wheels may guide the step in the forward path, and the step chain sprockets and the auxiliary rollers may guide the step in the reversing area.

In the reversing area, the auxiliary guide rails may include auxiliary outer guide rails for reversing the auxiliary rollers and inner auxiliary guide rails for reversing the auxiliary rollers. In this case, the outer auxiliary guide rails may extend into the return path to provide auxiliary guide rails for the return path that guide the auxiliary rollers in the return path.

In the forward path, as viewed in the lateral direction of said passenger conveyer system, an end part of rear wheel guide rail and an end part of the inner auxiliary guide rail may vertically overlap with each other, in a lapping range.

In this lapping range, the end part of the rear wheel guide rail in the lapping range may be provided with an inclined part sloping downward.

The distance between the pair or rear wheels may be shorter than the width of the step.

The rear wheels may protrude slightly downward from the lower end of the riser of the step.

The auxiliary roller may be disposed between the front wheel and the rear wheel, with the axis of the auxiliary roller being shifted toward a side of a tread of the step with respect to the axis of the rear wheel.

Each auxiliary roller may be supported by a support arm on an outer side of the step.

DESCRIPTION OF THE PREFERRED EMBODIMENTS

Figure 1:
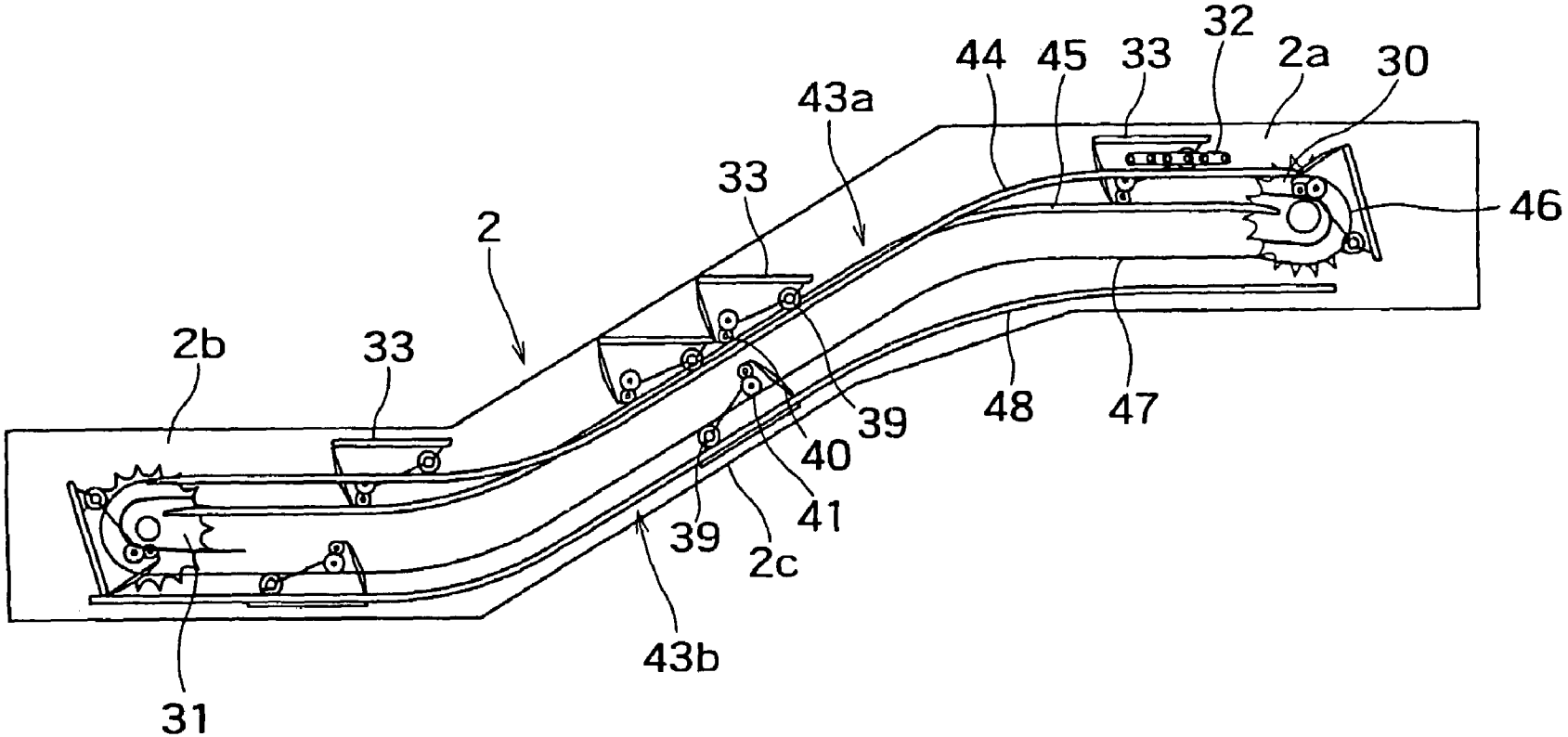
FIG. 1 s a schematic side elevation of a passenger conveyer system of the present invention.

Referring to FIG. 1 showing an escalator as a preferred embodiment of a passenger conveyer system according to the present invention, a frame 2 has an upper frame 2*a* installed on an upper floor, a lower frame 2*b* installed on a lower floor, and a middle frame 2*c* having opposite ends joined to the upper frame 2*a* and the lower frame 2*b*, respectively. Each of the upper frame 2*a* and lower frame 2*b* is provided with a pair of step chain sprockets 30, 31. Step chains 32 are extended between the step chain sprockets 30 and 31. A plurality of steps 33 are connected to the step chains 32. Each step 33 is provided with front wheels 39 and rear wheels 40, as mentioned later in detail. The step chains 32 are connected to the front wheels 39.

The step chain sprockets 30 are driven to turn the step chains 32 together with the steps 33 along a circulation loop. Each step 33 moves along a forward path (i.e., an upper section of the circulation loop), reaches to a position where the upper step chain sprockets 30 or the lower step chain sprocket 31 is arranged (i.e., a reversing area), turns over in the reversing area, and moves along the return path (i.e., an lower section of the circulation loop) in the opposite direction.

Figure 2:
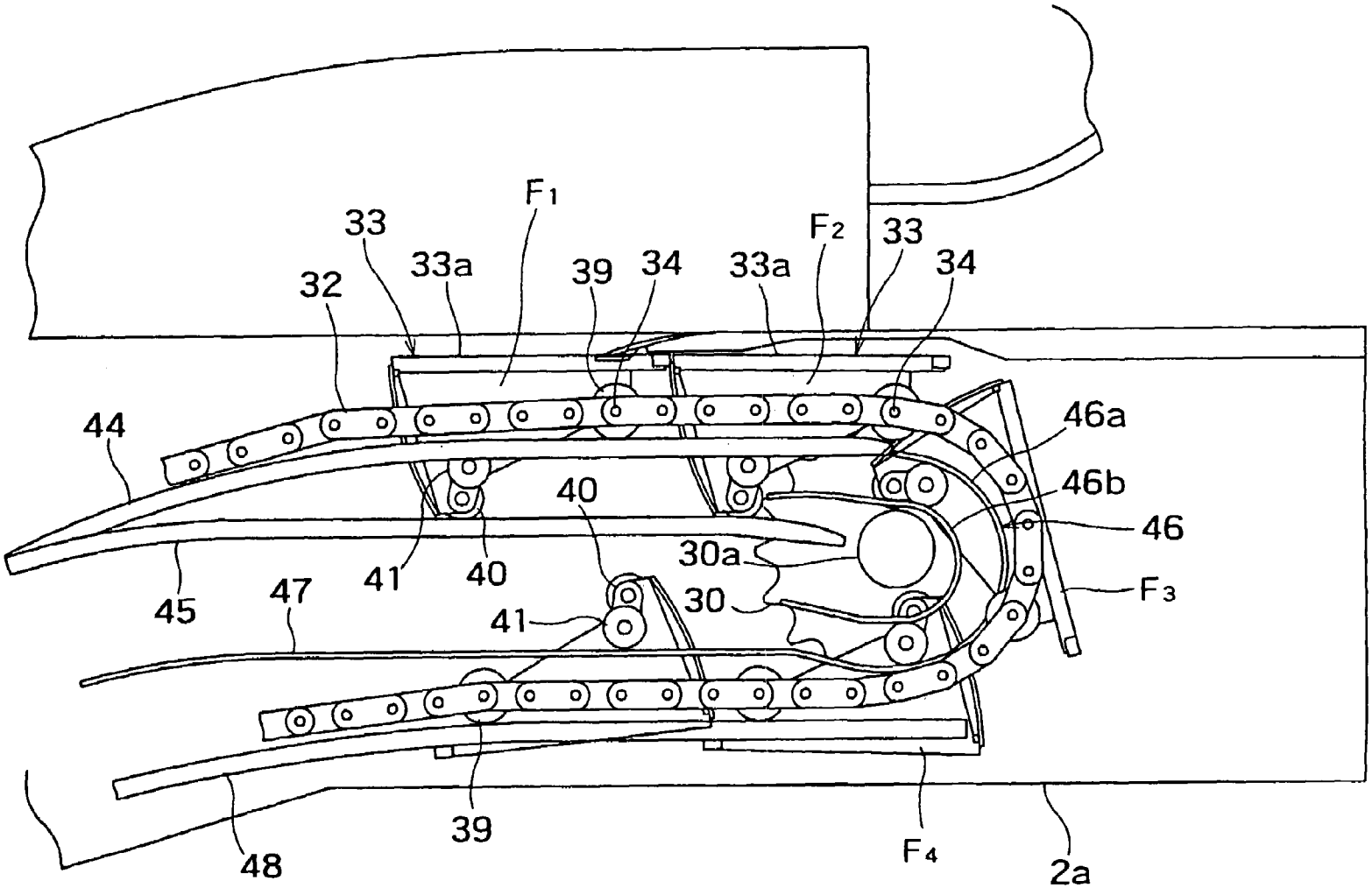
FIG. 2 is a sectional side elevation of an upper frame included in the passenger conveyer system of the present invention.
Figure 3:
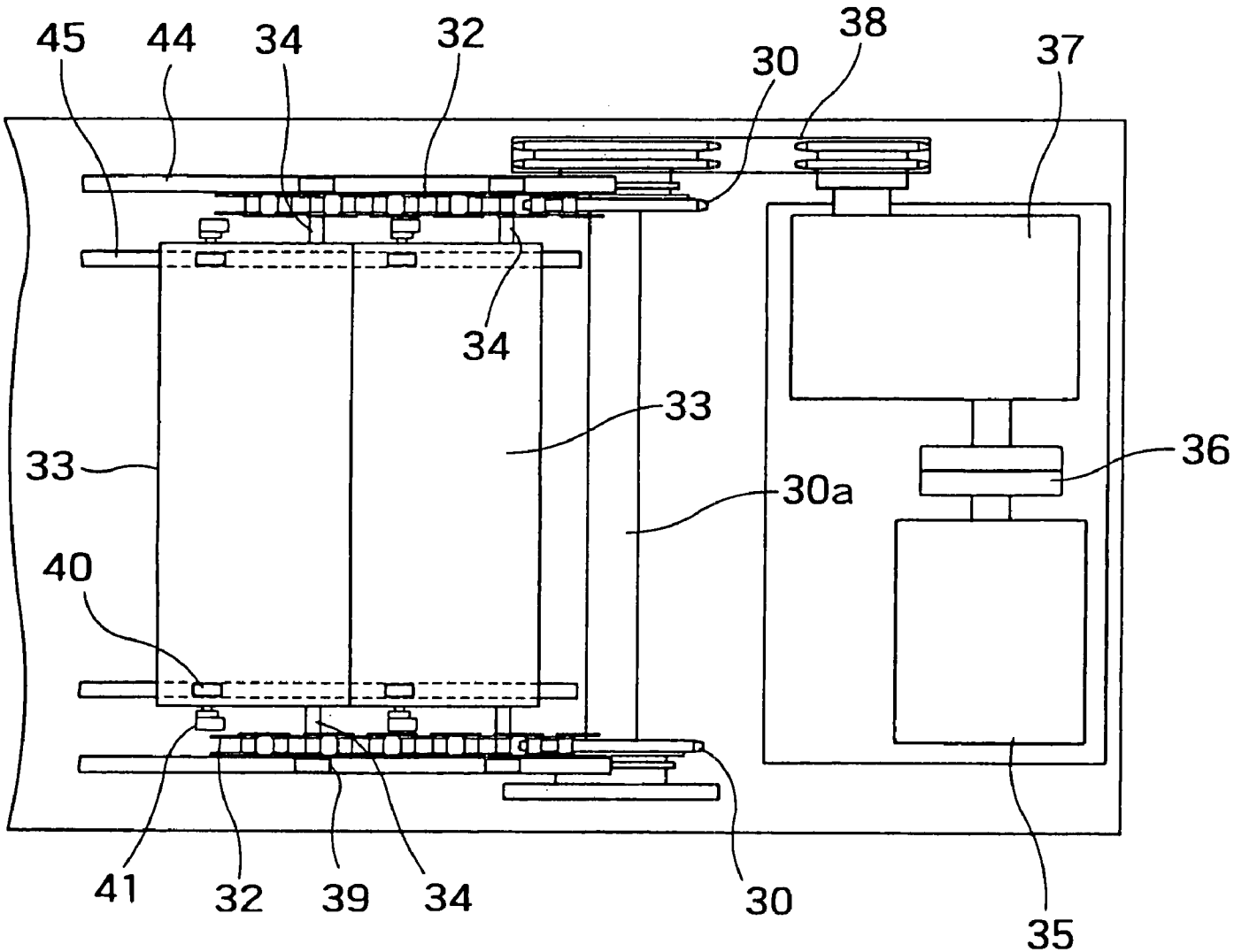
FIG. 3 is a plan view of the upper frame of the passenger conveyer system of the present invention.

FIG. 2 is a sectional side elevation of a part of the upper frame 2*a* of the escalator and FIG. 3 is a plan view of the part shown in FIG. 2. The pair of step chain sprockets 30, which are connected to each other by a connecting shaft 30*a*, are arranged in the upper frame 2*a*. The step chains 32 are wound around the step chain sprockets 30, respectively. Laterally opposite side parts of a front part of the step 33 are connected to the step chains 32 by shafts 34, respectively.

As shown in FIG. 3, a drive motor 35 for driving the step chain sprockets 30 is disposed in an end part of the upper frame 2*a*. The driving force of the drive motor 35 is transmitted through a coupling 36, a reduction mechanism 37 and a drive chain 38 to the connecting shaft 30*a* supporting the step chain sprockets 30.

Figure 4:
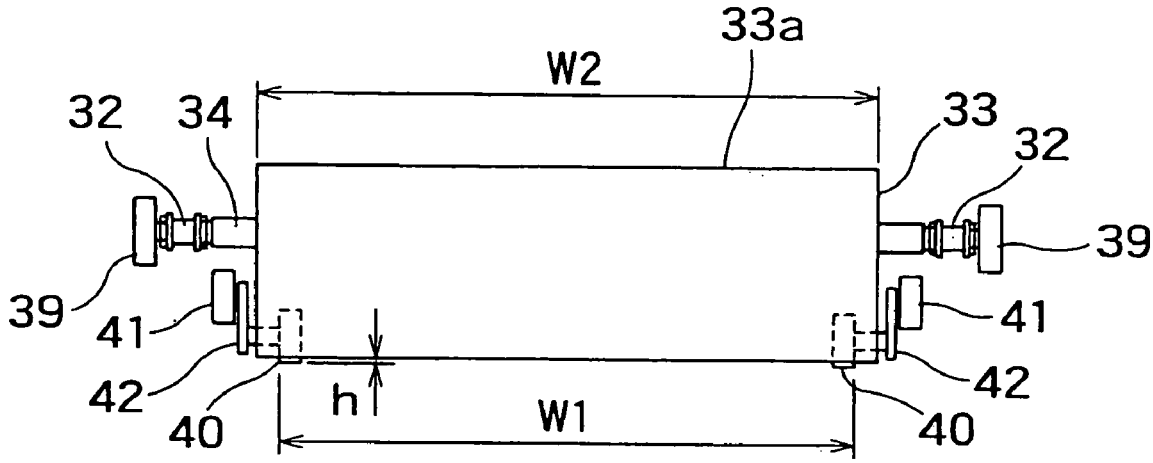
FIG. 4 is a front elevation of a step included in the passenger conveyer system of the present invention.
Figure 5:
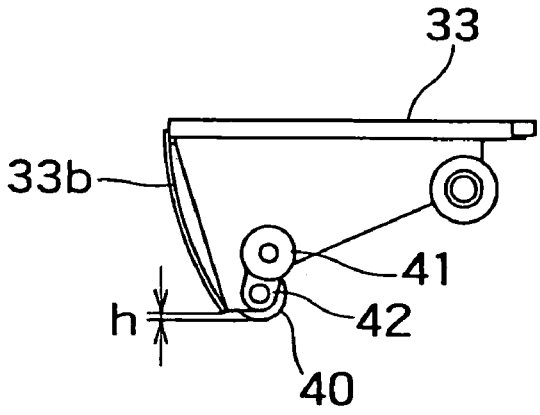
FIG. 5 is a side elevation of the step of the passenger conveyer system of the present invention.

Referring to FIGS. 4 and 5, the shafts 34 connecting the step 33 to the step chains 32 project outward from the step chains 32. The front wheels 39 are supported for rotation on the distal ends of the shafts 34. The front wheels 39 may be supported on shafts other than the shafts 34, although the front wheels 39 are supported on the shafts 34 in the illustrated embodiment. The step 33 is provided with a riser 33*b* on its rear end. The pair of rear wheels 40 are supported on a rear part close to the riser 33*b* such that a protruding part of the rear rollers 40 protrude downward by a small size h from the lower end of the riser 33*b*. The distance W1 between the rear wheels 40 is shorter than the width W2 of the tread 33*a* of the step 33. The size h of the protruding part of the rear roller 40 is determined so that lower end of the riser 33*b* may not touch the rear wheel guide rail 45 arranged in the forward path, practically in the range of 5 to 10 mm. Auxiliary rollers 41 are supported by support arms 42 on the outer side of the opposite sides of the step 33 at a level higher than that of the rear wheels 40.

Referring to FIG. 1, arranged in the forward path 43*a* are front wheel guide rails 44 for the forward path that support and guide the front wheels 39 and rear wheel guide rails 45 for the forward path that support and guide the rear wheels 40. The front wheel guide rails 44 and the rear wheel guide rails 45 are extended along laterally different lines respectively corresponding to the front wheels 39 and the rear wheels 40. Parts, in sloping part of the forward path, of the front wheel guide rails 44 and the rear wheel guide rails 45 are overlapped, as viewed in the lateral direction.

As shown in FIG. 2, end parts, near the reversing area, of each front wheel guide rail 44 and each rear wheel guide rail 45 are extended horizontally, and the end part of the front wheel guide rail 44 is at a level higher than that of the rear wheel guide rail 45 in order that the treads 33*a* of the adjacent steps 33 are included in a plane.

Auxiliary guide rails 46 that engage with the auxiliary rollers 41 are arranged in the reversing area to control the attitude of the step 33 while the moving direction of the step 33 is being reversed and the step 33 is being inverted in the reversing area. The auxiliary guide rails 46 include a U-shaped outer auxiliary roller guide rail 46 a and a U-shaped inner auxiliary roller guide rail 46*b*. The outer auxiliary roller guide rail 46*a* and the inner auxiliary roller guide rail 46*b* are extended around the connecting shaft 30*a* supporting the steps 30. In the reversing area, each auxiliary roller 41 moves along a U-shaped path defined by the outer and inner auxiliary roller guide rails 46*a* and 46*b*. A lower end part of the outer auxiliary roller guide rail 46*a* is joined to auxiliary roller guide rail 47 for the return path extended in the return path 43*b*.

The reversing area in the lower frame 2*b* is similar in construction to the reversing area in the upper frame 2*a*.

Front wheel guide rail 48 for the return path is extended along the auxiliary roller guide rail 47 for the return path under the auxiliary roller guide rail 47 in the return path 43*b*.

The step 33 moves along the forward path 43*a*, while the front wheels 39 being guided by the front wheel guide rails 44, and the rear wheels 40 being guided by the rear wheel guide rails 45. The step 33 moves along the return path 43*b*, while the front wheels 39 being guided by the front wheel guide rails 48, and the auxiliary rollers 41 being guided by the auxiliary roller guide rails 47 instead of the rear wheels 40.

Referring to FIG. 2, when the step 33 is moving to the right, as viewed in FIG. 2, along the forward path and is at a position F1, the front wheel guide rails 44 guide the front wheels 39, and the rear wheel guide rails 45 support and guide the rear wheels 40.

When the step 33 arrives at a position F2, the shafts 34 supporting the front wheels 39 engage with the teeth formed on the periphery of the step chain sprockets 30, and the step 33 starts turning-over movement. At this stage, the rear wheels 40 are still supported on the rear wheel guide rails 45.

Upon the arrival of the step 33 at a position F3, the step 33 reverses its moving direction, and the shafts of the front wheels 39 are engaged with the step chain sprockets 30, and the auxiliary rollers 41 are guided by the auxiliary guide rails 46. In this state, the rear wheels 40 are restrained by nothing and are not supported by any members.

The step 33 advances further in this state to a position F4. At the position F4, the step 33 is inverted completely upside down and enters into the return path. Then, the front wheel guide rails 48 for the return path support and guide the front wheels 39, and the auxiliary roller guide rails 47 for the return path support and guide the auxiliary rollers 41.

Figure 6:
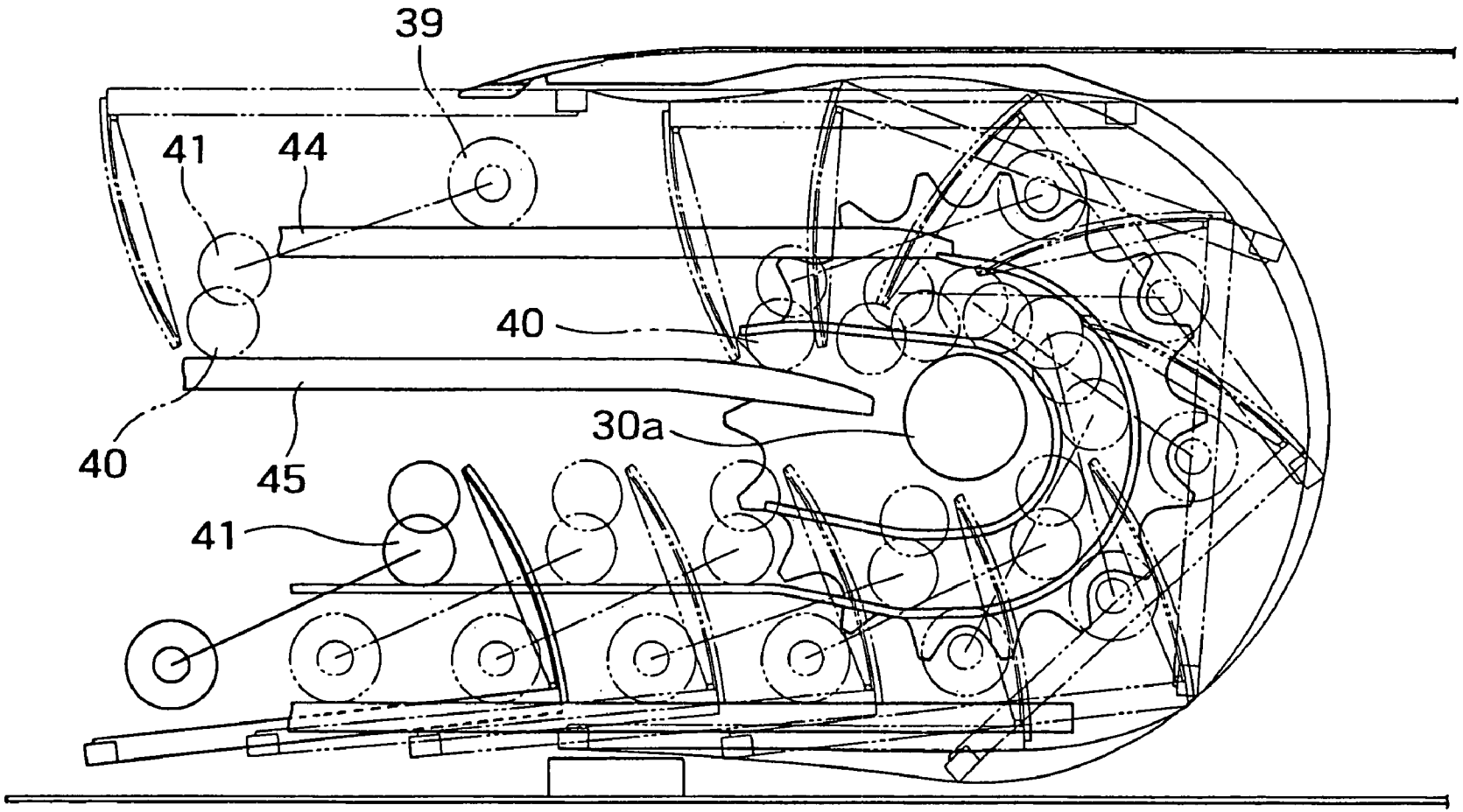
FIG. 6 is a side elevation of assistance in explaining the operation of an upper reversing unit included in the passenger conveyer system of the present invention.

FIG. 6 shows a locus of the step 33, i.e., the collection of points passed by the step 33 while the step 33 is being inverted. Just notice the locus of the rear wheel 40 that is neither guided nor supported. The rear wheel 40 moves as if it comes into collision with the connecting shaft 30*a* of the step chain sprockets 30 immediately after the step 33 has started being inverted.

As the step 33 is turned progressively for inversion, the rear wheel 40 starts moving upward and moves along a passage extending closely around the connecting shaft 30*a* while avoiding the connecting shaft 30*a*. When the shaft 34 of front wheel 39 along the step chain sprocket 30 while the auxiliary roller 41 being retained by the auxiliary roller guide rails 46, the rear wheel 40 is lifted up according to a seesaw-like pivotal action centered on the axis of the auxiliary roller 41, thereby achieving the aforementioned avoiding action of the rear wheel 40. It should be noted that it is impossible to cause the rear wheel 40 to make such a motion by guiding the rear wheel 40 by a guide rail extended along the locus of the rear wheel 40 shown in FIG. 6 without using the auxiliary roller 41. If such a guide rail is used for guiding the rear wheel 40, the step 33 is unable to advance beyond a position where the rear wheel 40 starts moving upward. Since the shaft 34 of the front wheel 39 of the step 33 is pulled obliquely downward, i.e., in the direction of a tangent to the sprocket 30, the rear wheel 40 controlled by the guide rail is unable to move in a direction, i.e., obliquely upward direction, different from the moving direction of the front wheel 39.

As the step 33 is progressively inverted, the rear wheel 40 moves away from the connecting shaft 30*a* as the rear wheel 40 goes around the connecting shaft 30*a*. As the step 33 is inverted further, the rear wheel 40 approaches the connecting shaft 30*a* again and passes a position under and close to the connecting shaft 30*a*.

Figure 7:
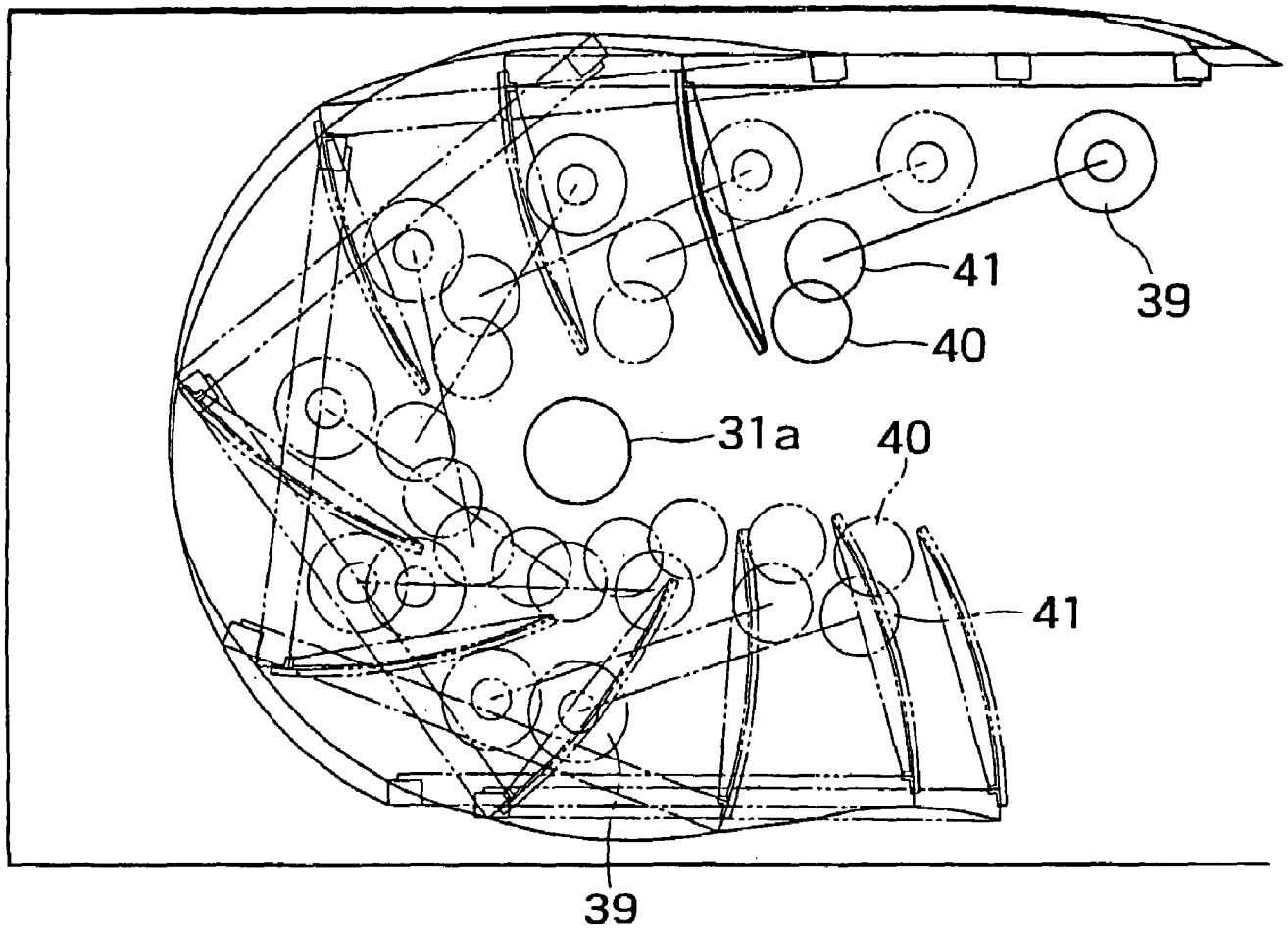
FIG. 7 is a side elevation of assistance in explaining the operation of a lower reversing unit included in the passenger conveyer system of the present invention.

FIG. 7 shows the successive positions of the step moving in the lower reversing area. As shown in FIG. 7, the rear wheel 40 turns around a connecting shaft 31*a* supporting the step chain sprocket 31 along a locus similar to that of the rear wheel 40 in the upper reversing area.

Thus, the rear wheels 40 and the lower rear end of the step 33 can be moved along the passages close to the connecting shafts 30*a* and 31*a*, avoiding the connecting shafts 30*a* and 31*a*, by guiding the auxiliary rollers 41 of the step 33 by the auxiliary roller guide structures 46. Clearances between the rear wheels 40 at a position right above the connecting shaft 30*a* and at a position right below the connecting shaft 31*a*, and the connecting shafts 30*a* and 31*a* are very small, which signifies that the step 33 can be inverted in a space having a small vertical dimension.

Figure 12:
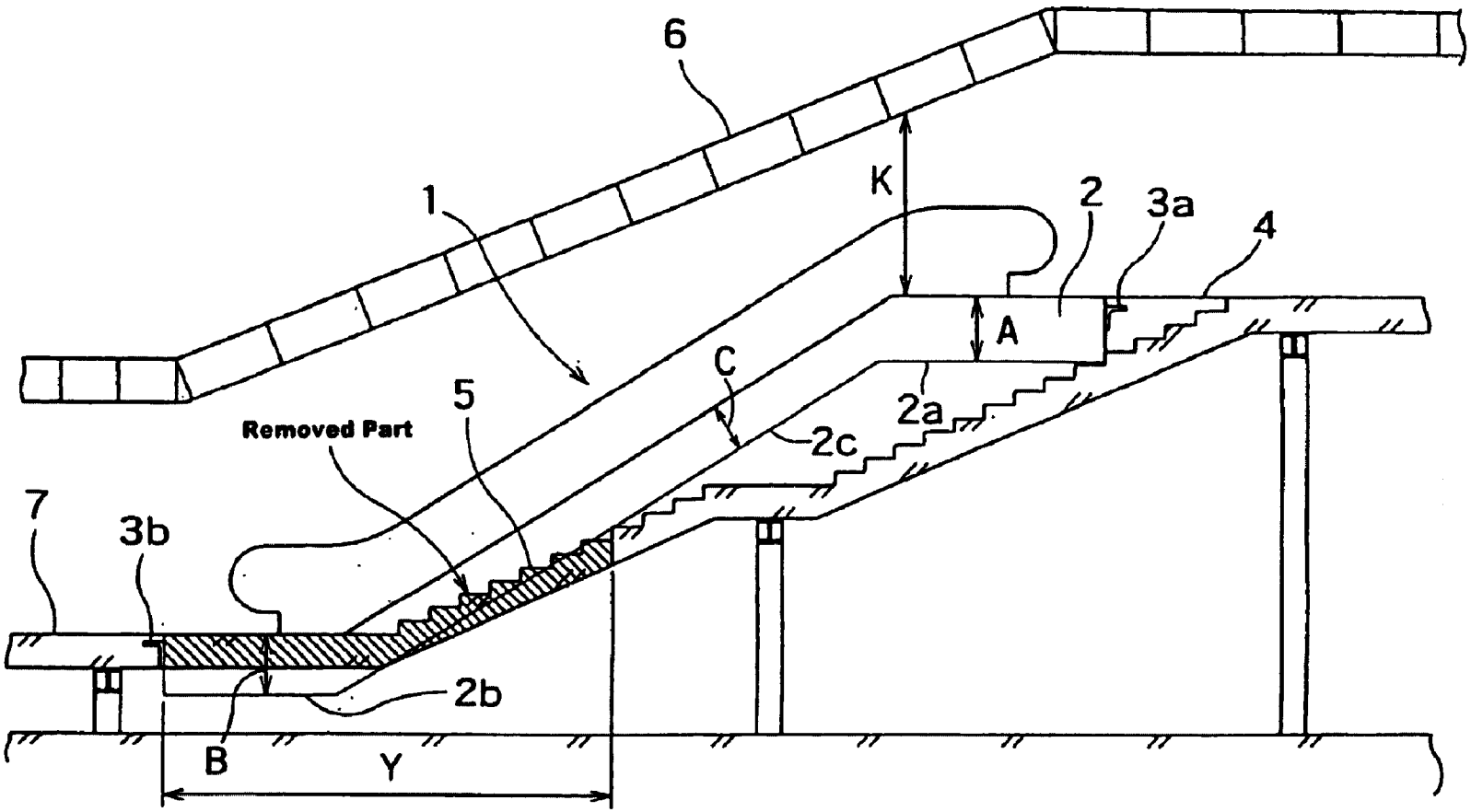
FIG. 12 is a side elevation of the passenger conveyer system of the present invention installed in a building.
Figure 13:
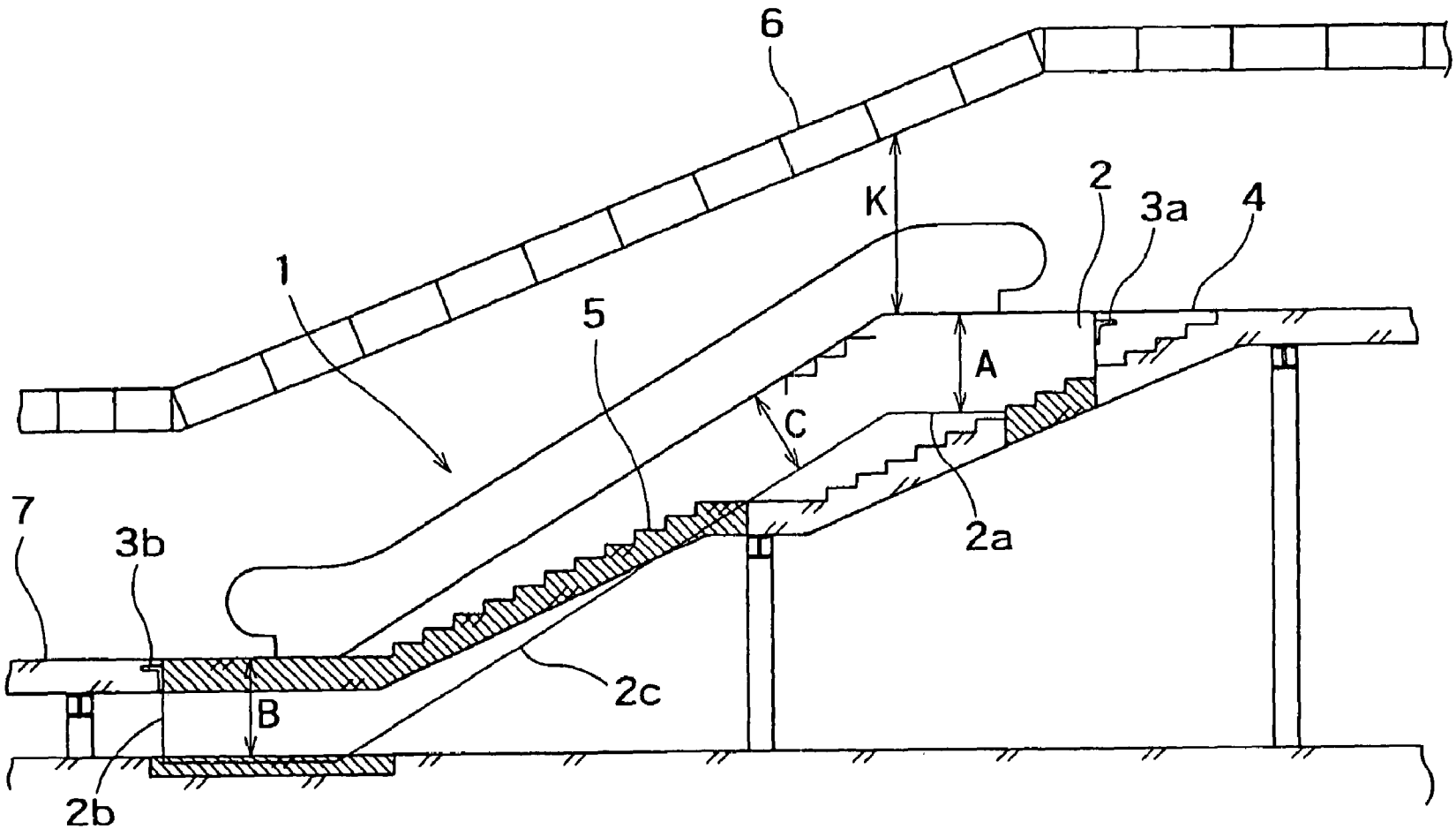
FIG. 13 is side elevation of a conventional passenger conveyer system installed in a building.
Figure 14:
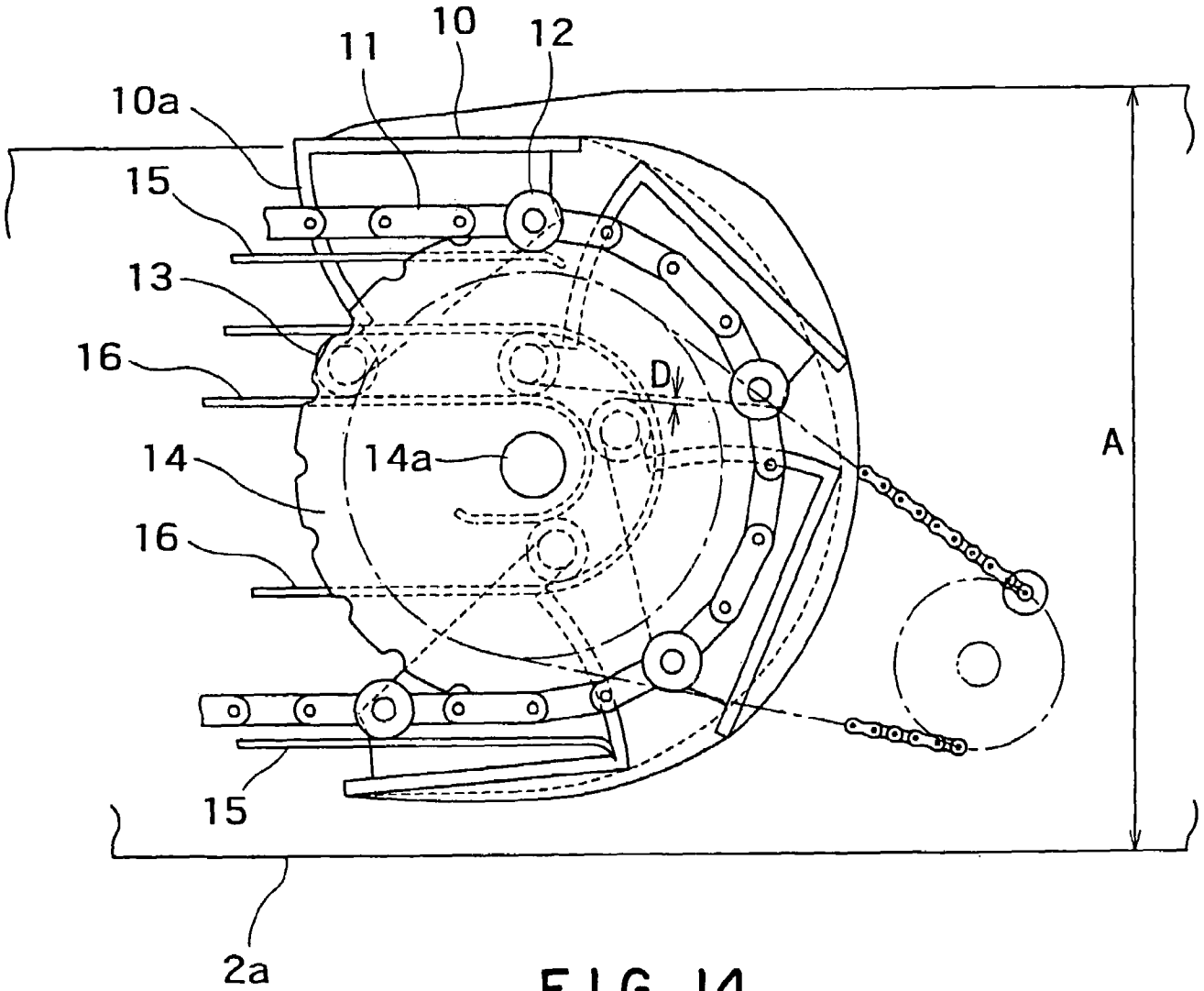
FIG. 14 is a side elevation of an upper reversing unit included in the conventional passenger conveyer system.
Figure 15:
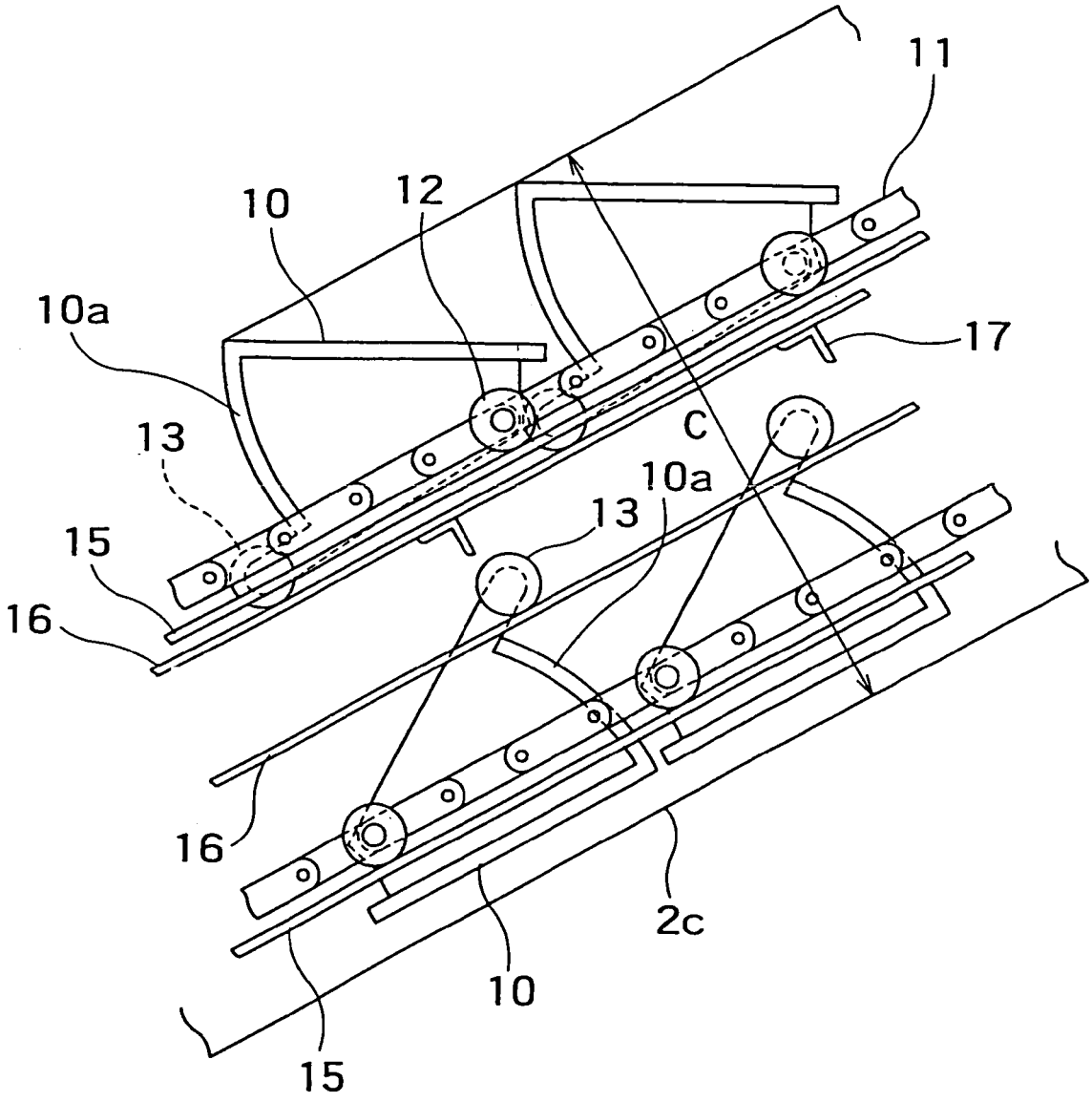
FIG. 15 is a sectional side elevation of a middle frame included in the conventional passenger conveyer system.
Figure 16:
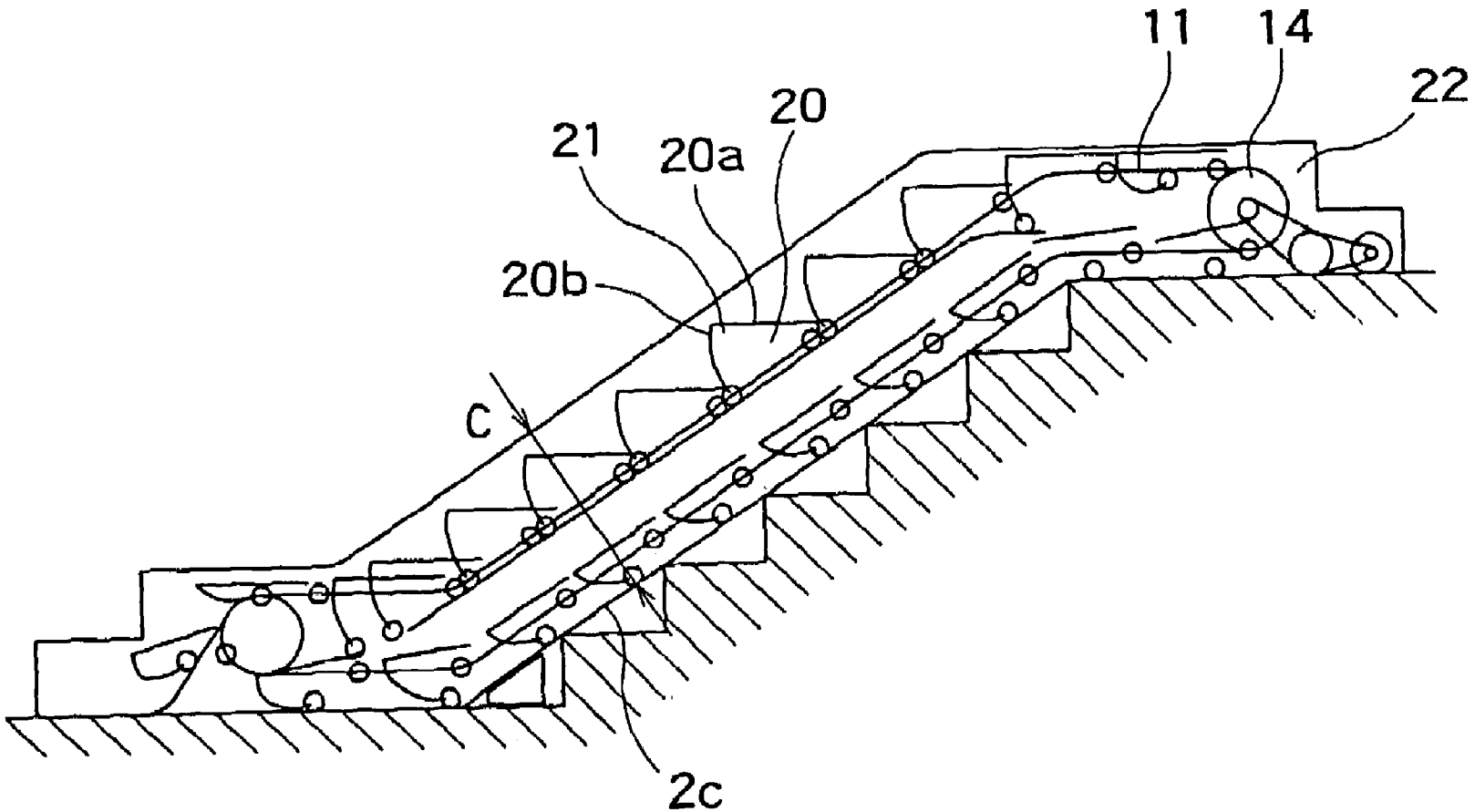
FIG. 16 is a schematic side elevation prior art passenger conveyer system.
Figure 17:
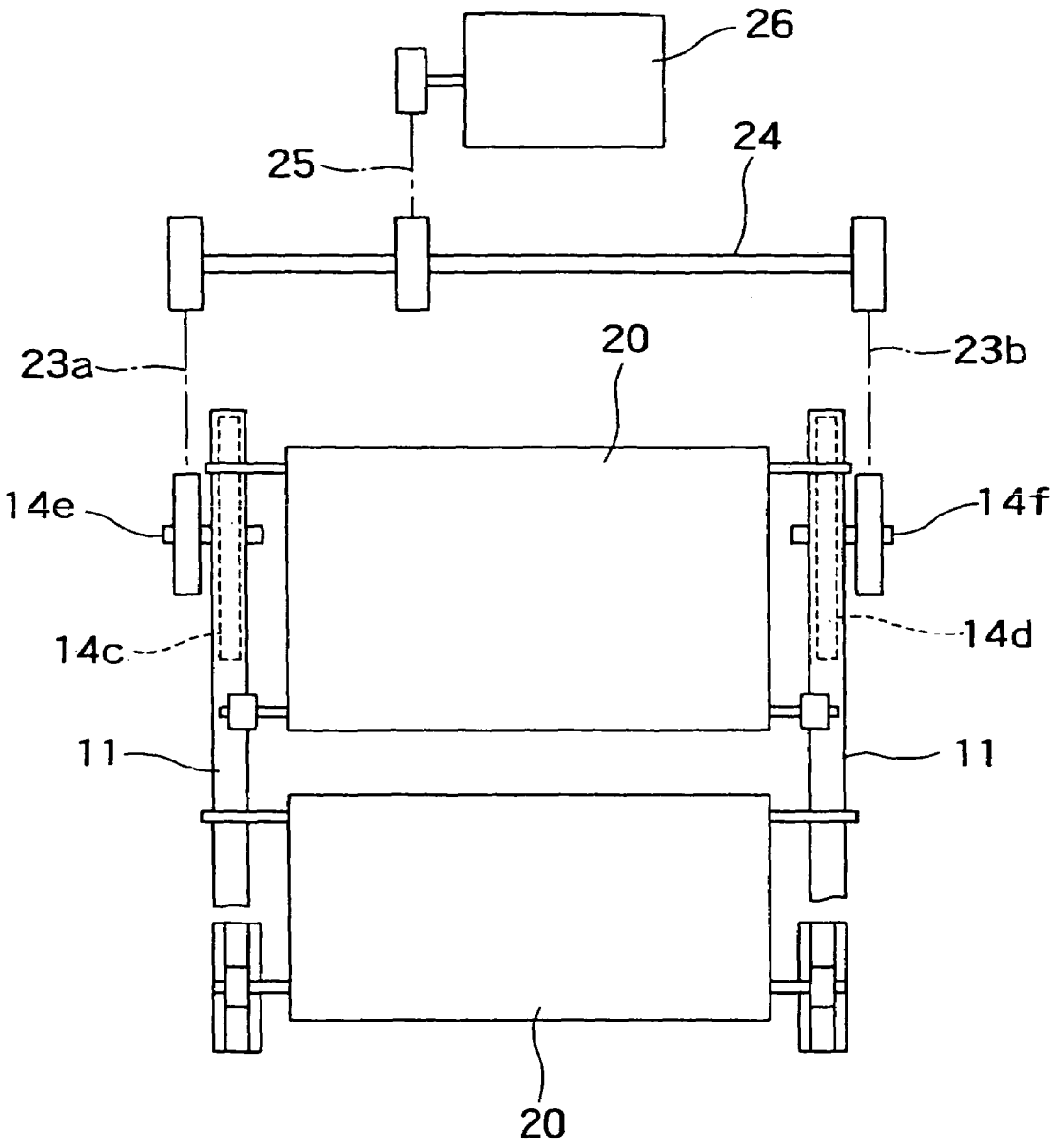
FIG. 17 is a plan view of the reversing unit included in the prior art passenger conveyer system.
Figure 18:
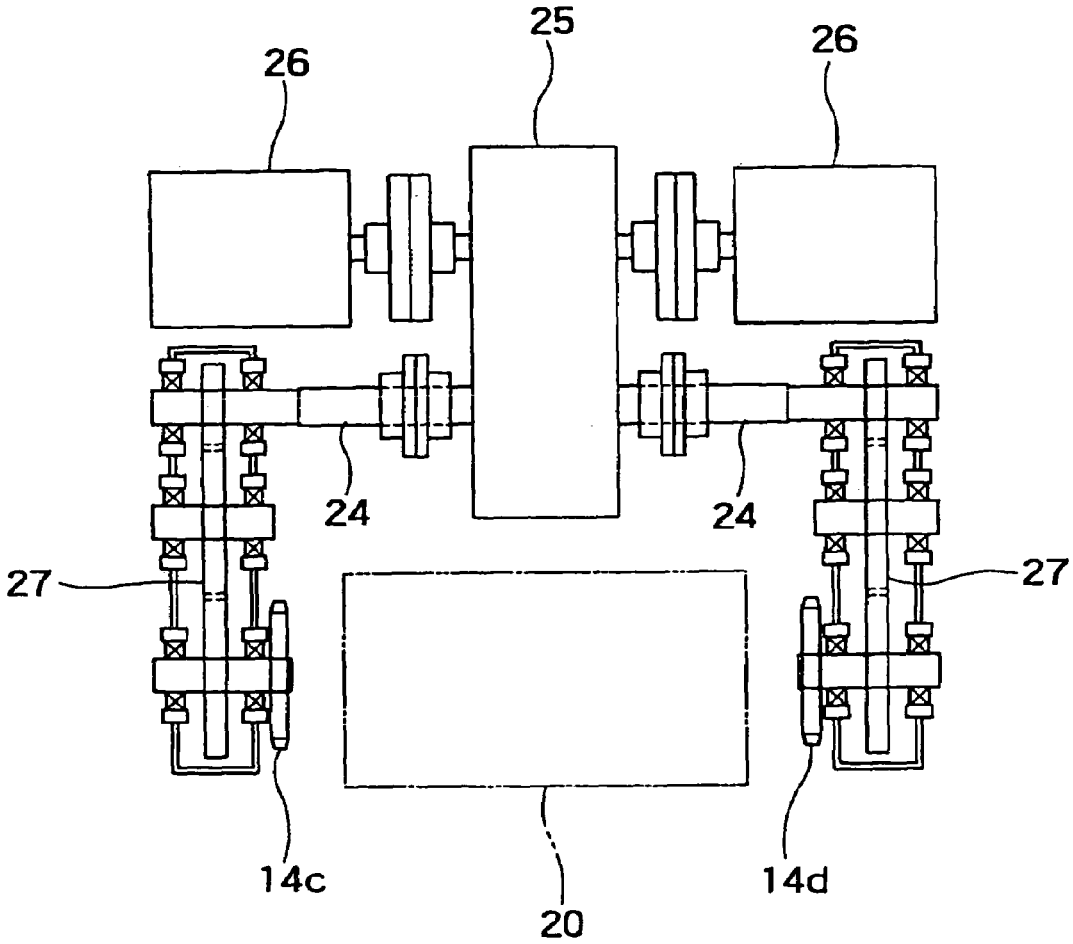
FIG. 18 is a plan view of a reversing unit included in another prior art passenger conveyer system.

Thus, the frame 2 has a small depthwise dimension. In installing the frame 2 in an existing station building or the like, an opening needs to be formed only in a part of a staircase corresponding to a lower end part of the frame indicated by a dimension Y in FIG. 12. Consequently, construction work relating to the building can greatly be reduced and the installation period can be shortened.

The front wheels 39 are supported and guided by the front wheel guide rails 44 and the rear wheels 40 are supported and guided by the rear wheel guide rails 45 while the step 33 moves along the forward path. The front wheels 39 are supported and guided by the front wheel guide rails 48 and the auxiliary rollers 41 are supported and guided by the auxiliary roller guide rails 47 while the step 33 moves along the return path.

Since the auxiliary rollers 41 continuously support and guide the step 33 when the step 33 moves along the return path, a change from a state where the rear rollers 40 support and guide the step 33 into a state where the auxiliary rollers 41 support and guide the step 33 is occurred only at positions just short of the upper and lower reversing areas. The effective use of the auxiliary rollers 41 not only in the reversing areas, but also in the return path reduces load on the rear wheels 40, and the rear wheels 40 and the auxiliary rollers 41 may be small as compared with the front rollers 39. Therefore, clearances between the rear wheels 40 and the auxiliary rollers 41, and the connecting shafts 30*a* and 31*a* supporting the step chain sprockets 30 and 31 can be easily secured.

The rear wheels 40 may be used instead of the auxiliary rollers 41 for supporting and guiding in the return path.

Figure 8:
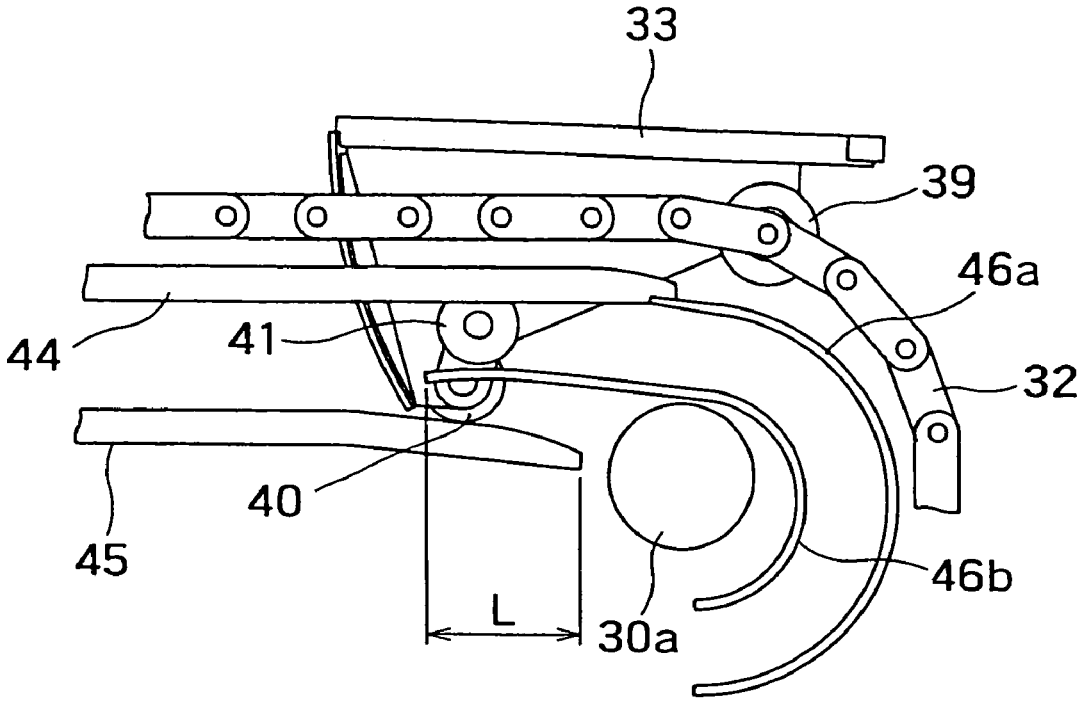
FIG. 8 is a side elevation of assistance in explaining the operation of the step in the upper reversing unit.
Figure 9:
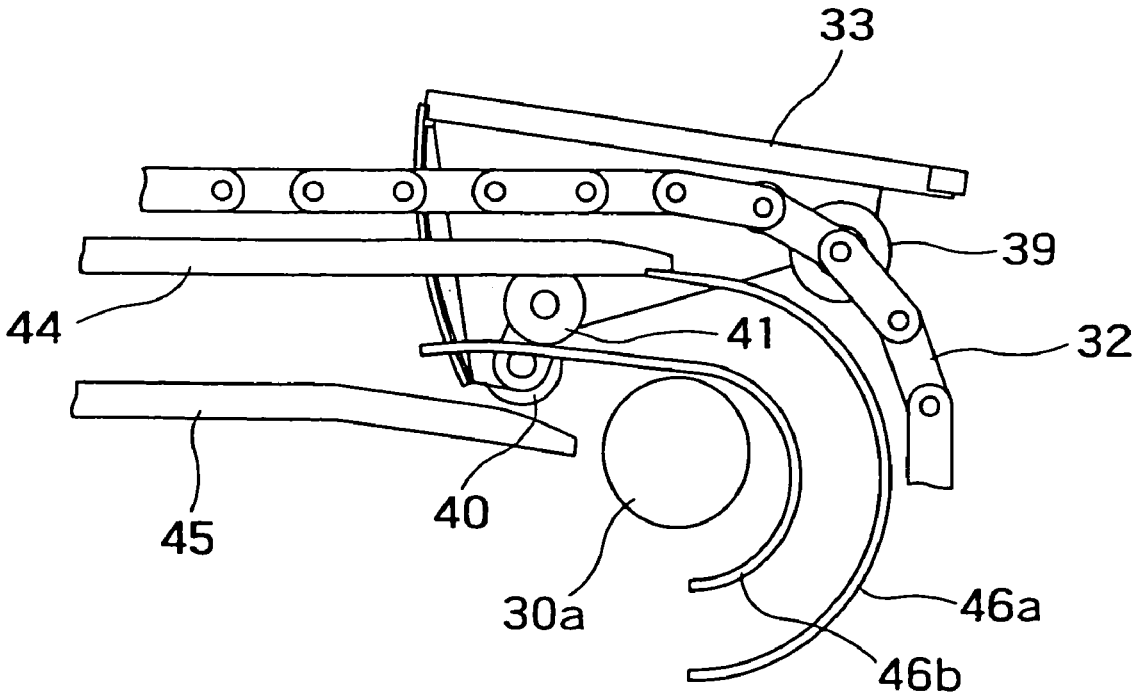
FIG. 9 is a side elevation of assistance in explaining the operation of the step in the upper reversing unit.
Figure 10:
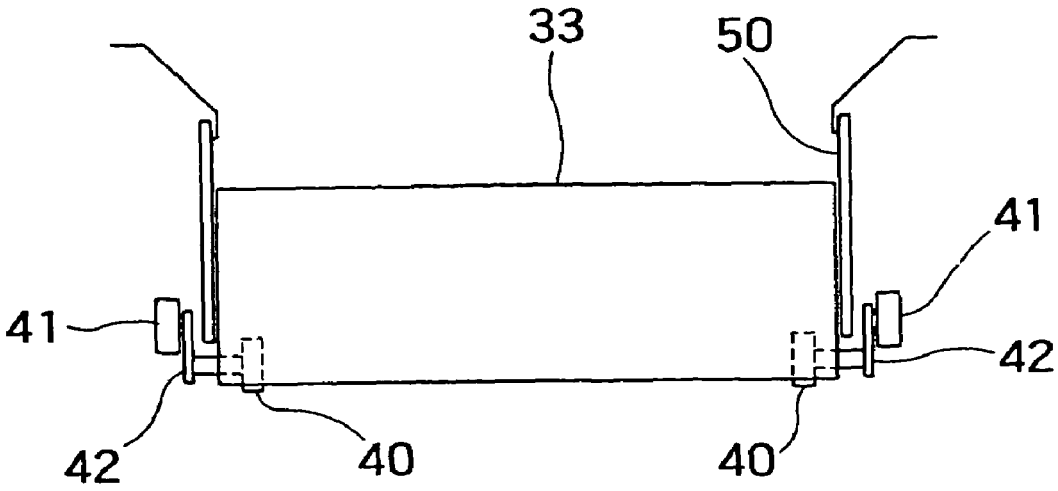
FIG. 10 is a front elevation of a step assembly included in the passenger conveyer system of the present invention.

FIGS. 8 and 9 show a change from a state where the forward path rear wheel guide rail 45 is supporting the rear wheel 40 into a state where the inner auxiliary roller guide rail 46*b* supports the auxiliary roller 41. As viewed in the lateral direction of the conveyer system, in a lapping range L, an end part of the rear wheel guide rail 45 for the forward path and a forward-path-side end part of the inner auxiliary roller guide rail 46*b* are located at different levels and overlap with each other. In the lapping range L, an end part of the guide surface of the rear wheel guide rail 45 slopes down toward the end of the rear wheel guide rail 45, and an end part, on the side of the forward path, of the inner auxiliary roller guide rail 46*b* slopes slightly down.

Supposing that the step 33 is moving to the right as viewed in FIG. 8, the rear wheels 40 are loaded and are rolling along the rear wheel guide rails 45, the auxiliary rollers 41 are not loaded and are not in contact with the inner auxiliary roller guide rails 46*b*. When the step 33 arrives at a position shown in FIG. 9, the auxiliary rollers 41 are loaded and roll on the inner auxiliary roller guide rails 46*b*, the rear wheels 40 are raised from the rear wheel guide rails 45 and are unloaded.

Since the end part of the rear wheel guide rail 45 underlies the end part of the corresponding inner auxiliary roller guide rail 46*b*, and those end parts slope downward, the wheels and the rollers are able to separate smoothly from the guide rails and are able to come smoothly into contact with the guide rails. Consequently, load can smoothly be transferred, and the generation of vibrations and noise can be reduced to a minimum.

Since the distance between the rear wheels 40 is shorter than the width of the tread 33*a* as shown in FIG. 4, the width of the frame 2 does not need to be increased greatly even though the auxiliary rollers 41 is provided. Since a part of each rear wheel 40 protrude slightly downward from the lower end of the riser 33*b* of the step 33, and the rear wheel 40 is disposed at the shortest possible distance from the riser 33*b*, the step 33 can be formed in a very small vertical dimension, the rear wheels 40 can be displaced greatly upward in an initial stage of inversion of the step 33 and, consequently, interference between the rear wheels 40, and the connecting shafts 30*a* and 31*a* supporting the step chain sprockets 30 and 31 can be easily avoided.

Figure 11:
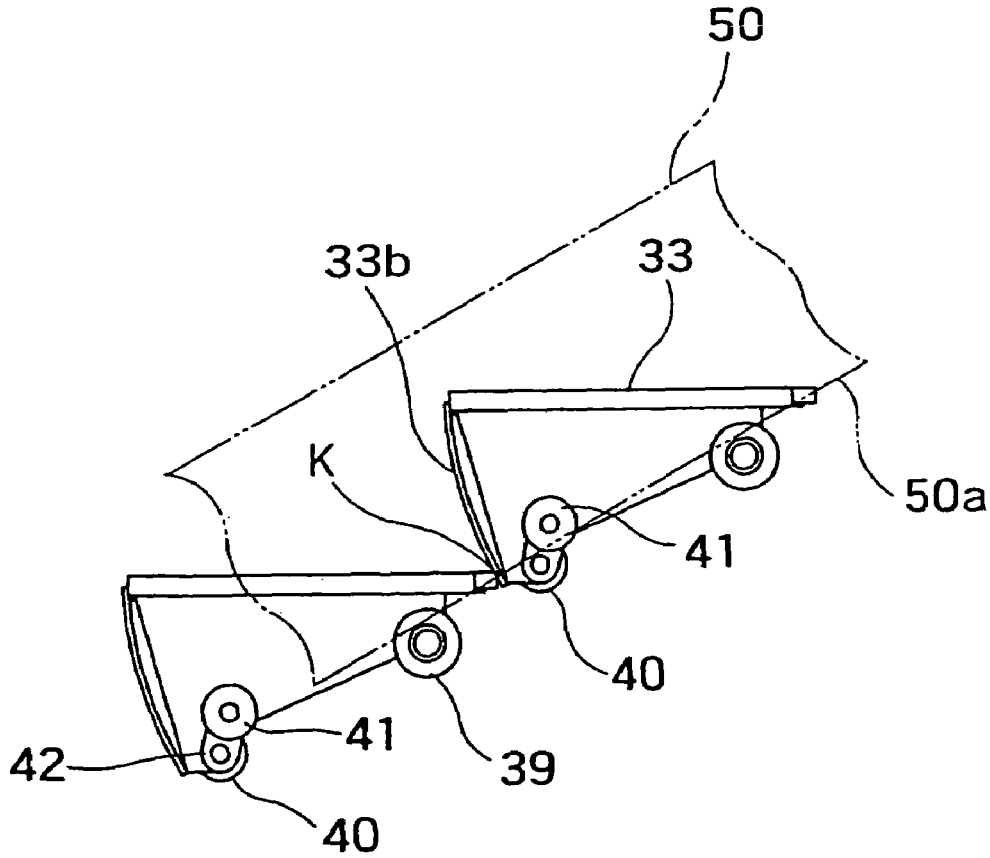
FIG. 11 is a side elevation of the step assembly of the passenger conveyer system of the present invention.

Skirt guards 50 are disposed beside the laterally opposite sides of the step 33, respectively. In the escalator in which the adjacent steps 33 are at different levels, respectively, the skirt guards 50 must cover the sides of the steps 33 to the intersection K of the tread and the riser as shown in FIG. 11. Therefore, the lower edges 50*a* of the skirt guards 50 lie near the lower ends of the risers 33*b* of the steps 33. Therefore, the skirt guards 50 make it difficult to support the auxiliary rollers 41 directly on optimum parts of the sides of the step 33. To overcome such a difficulty, the auxiliary rollers 41 are supported on the step 33 by the L-shaped support arms 42 that clear the lower edges 50*a* of the skirt guards 50. Thus, the skirt guards 50 are able to achieve their safety functions and the auxiliary rollers 41 can be disposed at optimum positions.

It is to be noted that the present invention is not limited in its practical application to the escalator in which the successive steps move in a stepped arrangement, and is applicable also to other passenger conveyer systems including a passenger conveyer system called a moving sidewalk provided with steps (pallets) that move in a plane.

The invention claimed is:

1. A passenger conveyer system comprising:

a plurality of steps each provided with front wheels and rear wheels;

a pair of endless step chains for carrying the steps in a successive arrangement;

a pair of step chain sprockets, around which the step chains are wound that reverses a moving direction of the steps to move the steps for circulation movement via the step chains;

a connecting shaft connecting the pair of step chain sprockets to each other;

a drive unit that drives the pair of step chain sprockets;

front-wheel guide rails and rear-wheel guide rails that guide the front wheels and rear wheels, respectively, to support and guide the steps in a forward path of a circulation loop of the steps, the rear-wheel guide rails being arranged so that the rear wheels leave the rear-wheel guide rails during a reversing motion of the step in a reversing area of the steps; and an auxiliary step guide arrangement configured to control the attitude of the steps in the reversing area of the circulation loop of the steps so that the steps turn over in the reversing area, the arrangement including at least one auxiliary guide rail structure and at least one guide member that engages with said at least one auxiliary guide rail.

2. The passenger conveyer system according to claim 1, wherein said at least one auxiliary guide member comprises a pair of auxiliary rollers respectively supported on opposite sides of each of the step; and said at least one guide rail structure comprises a pair of auxiliary guide rail structures that engage with the auxiliary rollers, respectively.

3. The passenger conveyer system according to claim 2, wherein the front wheels of each of the steps are connected to the step chains, respectively, whereby the step chain sprockets and the auxiliary rollers guide the step in the reversing area.

4. The passenger conveyer system according to claim 3, wherein, in the reversing area, the auxiliary guide rail structures include an auxiliary outer guide rail for reversing the auxiliary rollers and an inner auxiliary guide rail for reversing the auxiliary rollers.

5. The passenger conveyer system according to claim 4, wherein the outer auxiliary guide rails extend into the return path to provide auxiliary guide rails for the return path that guide the auxiliary rollers in the return path.

6. The passenger conveyer system according to claim 4, wherein, in the forward path, as viewed in a lateral direction of said passenger conveyer system, an end part of the rear-wheel guide rail and an end part of the inner auxiliary guide rail vertically overlap with each other, in a lapping range.

7. The passenger conveyer system according to claim 6, wherein the end part of the rear-wheel guide rail in the lapping range has an inclined part sloping downward.

8. The passenger conveyer according to claim 2, wherein a distance between the rear wheels is shorter than a width of the step.

9. The passenger conveyer according to claim 2, wherein the rear wheels protrude slightly downward from the lower end of a riser of the step.

10. The passenger conveyer system according to claim 2, wherein the auxiliary roller is disposed between the front wheel and the rear wheel, with the axis of the auxiliary roller being shifted toward a side of a tread of the step with respect to the axis of the rear wheel.

11. The passenger conveyer system according to claim 2, wherein each auxiliary roller is supported by a support arm on an outer side of the step.

12. A passenger conveyer system comprising:

a plurality of steps each provided with a front wheel, a rear wheel and an auxiliary guide roller;

an endless step chain for carrying the steps in a successive arrangement;

a pair of step chain sprockets, around which the step chains are wound, and which reverses, via the step chain, a moving direction of the steps to move the steps of circulation movement along a circulation loop of the step, the circulation loop including a forward path and a reversing area;

a drive unit that drives at least one of the chain sprockets for the circulation movement of the step;

a front-wheel guide rail that guides the front wheel to support and guide each of the steps in the forward path;

a rear-wheel guide rail that guides the rear wheel to support and guide each of the steps in the forward path, the rear-wheel guide rail being arranged so that the rear wheel leaves the rear-wheel guide rail during a reversing motion of the step in the reversing area; and an auxiliary guide rail structure that guides the auxiliary guide roller in the reversing area to guide and support each of the steps so that the step turns over in the reversing area, the auxiliary guide rail structure including an inner rail that supports the auxiliary guide roller in the reversing area in an early stage of a turning-over movement of the step, and an outer rail that supports the auxiliary guide roller in the reversing area in a later stage of the turning-over movement of the step.

13. The passenger conveyer system according to claim 12, wherein a shaft of the front wheel of each of the steps is connected to the step chain, whereby the step chain sprocket and the auxiliary guide rail structure guide and support the steps in the reversing area.

14. The passenger conveyer system according to claim 12, wherein the outer rail of the auxiliary guide rail structure extends into a return path of the circulation loop to provide an auxiliary guide rail for the return path that guide the auxiliary roller in the return path, said system further comprising a front-wheel guide rail for the return path that guides the front wheel of each of the steps, wherein, in the return path, the steps are guided and supported by the front-wheel guide rail for the return path and the auxiliary guide rail for the return path.

15. The passenger conveyer system according to claim 12, wherein, in the forward path, as viewed in a lateral direction of said passenger conveyer system, an end part of the rear-wheel guide rail and an end part of the inner rail of the auxiliary guide rail structure vertically overlap with each other, in a lapping range.

16. The passenger conveyer system according to claim 15, wherein the end part of the rear-wheel guide rail in the lapping range has an inclined part sloping downward.

17. The passenger conveyer system according to claim 12, wherein, as viewed in a lateral direction of said passenger conveyer system, each of the inner and outer guide rails of the auxiliary guide rail structure has a U-shape and extends around a shaft of the chain sprocket.

18. A passenger conveyer system comprising:

a plurality of steps each provided with front wheels and rear wheels;

a pair of endless step chains for carrying the steps in a successive arrangement;

a pair of step chain sprockets, around which the step chains are wound, that reverses a moving direction of the steps to move the steps for circulation movement via the step chains;

a connecting shaft connecting the pair of step chain sprockets to each other;

a drive unit that drives the pair of step chain sprockets;

guide rails that support and guide the steps in a forward path and a return path of a circulation loop of the steps; and auxiliary step guide means configured to control the attitude of the step in a reversing area of the circulation loop of the steps without supporting and guiding the rear wheels of the step, wherein the auxiliary step guide means includes auxiliary rollers respectively supported on opposite sides of each of the step and auxiliary guide rails that engage with and guide the auxiliary rollers, wherein the front wheels and the rear wheels guide the step in the forward path, and the step chain sprockets and the auxiliary rollers guide the step in the reversing area, and wherein, in the reversing area, the auxiliary guide rails include auxiliary outer guide rails for reversing the auxiliary rollers and inner auxiliary guide rails for reversing the auxiliary rollers.

19. The passenger conveyer system according to claim 18, wherein the outer auxiliary guide rails extend into the return path to provide auxiliary guide rails for the return path that guide the auxiliary rollers in the return path.

20. The passenger conveyer system according to claim 18, wherein, in the forward path, as viewed in a lateral direction of said passenger conveyer system, an end part of rear wheel guide rail and an end part of the inner auxiliary guide rail vertically overlap with each other, in a lapping range.

21. The passenger conveyer system according to claim 20, wherein the end part of the rear wheel guide rail in the lapping range has an inclined part sloping downward.

* * * * *